US009537249B2

(12) United States Patent
Grudzewski et al.

(10) Patent No.: US 9,537,249 B2
(45) Date of Patent: Jan. 3, 2017

(54) CONDUIT ADAPTER HAVING A SHELL WITH FIXING AND PRE-LOCKING ELEMENTS

(71) Applicant: DELPHI TECHNOLOGIES, INC., Troy, MI (US)

(72) Inventors: Michal Grudzewski, Cracow (PL); Krzysztof Pitala, Mszana Dolna (PL)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/011,970

(22) Filed: Feb. 1, 2016

(65) Prior Publication Data

US 2016/0240954 A1 Aug. 18, 2016

(30) Foreign Application Priority Data

Feb. 12, 2015 (EP) ..... 15154926

(51) Int. Cl.

| | |
|---|---|
| ***H01R 13/58*** | (2006.01) |
| ***H01R 13/506*** | (2006.01) |
| ***H01R 13/502*** | (2006.01) |
| ***H01R 43/00*** | (2006.01) |
| ***H01R 13/56*** | (2006.01) |

(52) U.S. Cl.

CPC ..... *H01R 13/506* (2013.01); *H01R 13/502* (2013.01); *H01R 13/562* (2013.01); *H01R 13/582* (2013.01); *H01R 13/5812* (2013.01); *H01R 43/00* (2013.01)

(58) Field of Classification Search

CPC ..... H01R 13/502; H01R 13/506; H01R 13/58; H01R 13/582; H01R 13/62; H01R 13/627; H01R 13/639

USPC ..... 439/449, 352–358

See application file for complete search history.

(56) References Cited

U.S. PATENT DOCUMENTS

| | | | | |
|---|---|---|---|---|
| 3,638,169 | A | 1/1972 | Caveney | |
| 6,869,306 | B1 * | 3/2005 | Sung | H01R 13/506 439/449 |
| 6,962,504 | B2 * | 11/2005 | Fukui | H01R 13/567 439/466 |
| 7,494,376 | B1 * | 2/2009 | Foltz | H01R 13/567 439/596 |
| 8,192,229 | B2 * | 6/2012 | Endo | H01R 13/501 439/596 |
| 2005/0003699 | A1 | 1/2005 | Fukui et al. | |

(Continued)

FOREIGN PATENT DOCUMENTS

| | | | |
|---|---|---|---|
| FR | 2770041 | A1 | 4/1999 |
| JP | 2008293810 | A | 12/2008 |
| WO | 2013027352 | A1 | 2/2013 |

*Primary Examiner* — Chandrika Prasad
(74) *Attorney, Agent, or Firm* — Robert J. Myers

(57) ABSTRACT

The present invention relates to a conduit adapter system comprising a conduit adapter that is assigned to an electrical connector assembly. The conduit adapter comprises a first shell and a second shell, wherein the first shell comprises first fixing elements and the second shell comprises corresponding second fixing elements. The first shell further comprises a pre-locking means that can be engaged with corresponding pre-locking means of the electrical connector assembly, to lock the first shell to the electrical connector assembly in a pre-assembled condition. A method of assembling such a conduit adapter system is also presented.

17 Claims, 4 Drawing Sheets

(56) References Cited

U.S. PATENT DOCUMENTS

| | | | | |
|---|---|---|---|---|
| 2005/0181670 | A1* | 8/2005 | Kumamoto | H01R 13/6275 439/358 |
| 2010/0255704 | A1* | 10/2010 | Gardner | G01G 23/017 439/301 |
| 2011/0065308 | A1* | 3/2011 | Lu | H01B 7/0892 439/449 |
| 2011/0256756 | A1* | 10/2011 | Lu | H01B 7/0892 439/449 |

* cited by examiner

CONDUIT ADAPTER HAVING A SHELL WITH FIXING AND PRE-LOCKING ELEMENTS

CROSS-REFERENCE TO RELATED APPLICATION

This application claims the benefit under 35 U.S.C. §119 (a) of Patent Application No. 15154926.8 filed in the European Patent Office (EPO) on Feb. 12, 2015, the entire disclosure of which is hereby incorporated by reference.

TECHNICAL FIELD OF THE INVENTION

The present invention relates to conduit adapter systems comprising a conduit adapter that is assigned to an electrical connector assembly. Furthermore, the present invention also relates to a method to assemble the conduit adapter systems.

BACKGROUND OF THE INVENTION

Conduit adapters are commonly used to protect electrical cables that enter or exit an electrical connector assembly. In particular the cables are protected from environmental influences, such as temperature, dust, moisture and/or the like. Still further conduit adapters can provide strain relief functionality and/or protect the cables from unallowed cable bending and thus prevent cable damages.

Conduit adapters can provide connecting means between cable channels, and in particular flexible cable channels and electrical connector assemblies. Conduit adapters are for example widely used in automobile applications, industrial applications and/or consumer electronic applications.

Conduit adapter systems known in the art typically include two separate parts that can be connected together to form the conduit adapter around the cable to be protected. Providing a two-part adapter allows the conduit adapter to be installed after the installation of the connector and the respective cable. However, in an industrial manufacturing process two separate parts are undesired, since the number of individual parts increases the complexity of the manufacturing process and in particular the supply process of the parts.

Therefore, the single parts of known conduit adapters are usually connected via a hinge, so that only one physical part has to be handled in the supply process. Known hinges are orientated at a longitudinal axis at the sides of the parts of the conduit adapter. This allows the parts to be rotated around an axis parallel to the cables of the electrical connector assembly, when the parts shall be connected. However, providing a hinge at the longitudinal axis, i.e. at the sides of the parts is disadvantageous, since there is less space to provide fixing means. Thus the fixing means on the hinge-side have to be designed smaller and therefore weaker, than the fixing means on the non-hinge-side of a conventional conduit adapter.

Still further, the connection between electrical connector system and conduit adapter is typically achieved by clamping or engaging the electrical conductor system when the two parts of the conduit adapter are connected. Thus, in order to finally mount the conduit adapter three parts, namely two conduit adapter parts and the electrical connector, have to be handled.

The object of the present invention is to provide conduit adapter systems and a method to assemble the conduit adapter systems, which overcomes the problems and drawbacks described above.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

A conduit adapter system is provided herein. The conduit adapter system includes a conduit adapter being assigned to an electrical connector assembly, wherein the conduit adapter includes a first shell and a second shell. The first shell of the conduit adapter includes a first fixing element and the second shell of the conduit adapter includes a corresponding second fixing element, so that the first and second shell can be fixed together. Further, the first shell includes a pre-locking means that can be engaged with corresponding pre-locking means of the electrical connector assembly, to lock the first shell to the electrical connector assembly in a pre-assembled condition.

Providing a first and a second shell that can be fixed together allows an installation of the conduit adapter, when the electrical connector assembly and respective cables are already mounted in a more complex system such as a harness or the like. Thereby, a first and/ or second fixing element can be any kind of element that is suitable to fix the first and second shell together in a releasable or permanent manner, such as screws, bolts, rivets, pins, clamps and/or the like. A combination of different fixing elements is also possible.

Providing pre-locking means at the first shell of the conduit adapter allows the conduit adapter to be locked to the electrical connector assembly, before the first and second shell are fixed together. This is advantageous, since during the installation of the conduit adapter only two parts have to be handled separately at once. In a first step, the first shell of the conduit adapter can be pre-locked to the electrical connector assembly to arrive at the preassembled condition. In this preassembled condition the shell is securely (pre-) attached to the connector assembly, so than an operator can use both hands to e.g. arrange the cables of the connector and to fix the second shell to the first shell. It is thus advantageously no longer necessary to hold the shell(s) manually.

The pre-locking means can be any kind of means that is suitable to provide a releasable or permanent connection between the first shell of the conduit adapter and the electrical connector assembly, such as screws, bolts, rivets, pins, clamps, adhesives and/or the like.

Further, a pre-locking means of the first shell and the corresponding pre-locking means of the electrical connector assembly can be formed as latching protrusions and corresponding latching recesses.

A latching connection that is achieved by engaging a latching protrusion and a corresponding latching recess is advantageous, since those latching connections can be locked rapidly and possibly without the use of additional tools. The latching protrusion can either be formed on the first shell of the conduit adapter or on the electrical connector assembly.

Further, the first shell of the conduit adapter can include a first groove that can be engaged with a first collar of the electrical connector assembly in the pre-assembled condition. The first groove increases the mechanical stability of the connection between the conduit adapter and the electrical connector assembly, particularly in axial direction of the cables of the electrical connector assembly, when it is engaged with the first collar of the electrical connector assembly. Still further, the combination of groove and collar can provide sealing functionality and prevent the penetration of moisture and contaminants in the conduit adapter.

Still further, the collar and the groove facilitate the orientation of the first shell to the electrical connector assembly during the locking of the pre-locking means, and therefore allow a fast pre-locking.

The pre-locking means of the first shell may be formed as a latching protrusion. Additionally, the pre-locking means of the first shell may be arranged in the first groove, and the corresponding pre-locking means of the electrical connector assembly is formed as a latching recess that is formed in the first collar of the electrical connector assembly. By arranging the latching protrusion in the first groove, and by forming a corresponding latching recess in the first collar, the required space to form the pre-locking means and the collar/groove can be reduced to a minimum. Thus the size of the conduit adapter needs not to be increased to provide the new pre-locking feature.

The second shell includes a second groove that can be engaged with a second collar of the electrical connector assembly, wherein the second collar may be integrally formed with the first collar of the electrical connector assembly.

The second groove and the second collar are engaged when the first and second shell are fixed together. Providing a second groove and a second collar is advantageous, since the mechanical stability of the connection between the conduit adapter and the electrical connector assembly in particular in axial direction (i.e. in the longitudinal direction of the cables) can be further improved. Further, by applying a second collar, fixing of the second shell to the first shell is facilitated, since the second shell can be guided by the collar and the corresponding second groove in the correct position, even before the fixing elements are fixed to each other. Thus, a manufacturer has the possibility to monitor the correct position of the first and second shell before the fixing elements are fixed.

The first shell includes at least two, and possibly four, first fixing elements that are formed identically, wherein the second shell includes corresponding second fixing elements.

Providing identical fixing elements is advantageous, since the fixing forces of the single fixing connections are distributed uniformly over the conduit adapter. Further, this facilitates the design of the conduit adapter. Still further, the conduit adapter can be assembled with identical fixing-forces on the right hand and left hand side of the adapter. Yet still further, when latching connections are used, the correct connection of the identical latching connections can be easily controlled by the uniform clicking sound of the identical latching connections.

The first fixing elements and the corresponding second fixing elements may be formed as latching recesses and corresponding latching protrusions, and possibly as latching hooks and latching noses.

A latching connection that is achieved by engaging a latching protrusion and a corresponding latching recess is advantageous, since those latching connections can be locked rapidly, possibly without the use of additional tools. Thereby, the latching protrusions can be either provided on the first shell or on the second shell. Combinations of latching protrusions and latching recesses on a shell of the conduit adapter are also possible.

The latching protrusions and latching recesses may be arranged in that manner, that the second shell can be positioned relative to the first shell and is guided by the latching elements from an un-latched to a latched condition. Thus the fixing of the second shell to the first shell is facilitated.

The latching hooks may be U-shaped. A U-shaped hook includes two legs and a cross bar. Such latching hooks are advantageous, since they can provide high latching forces and therefore a strong and secure connection. Still further, the risk of tangling up the latching hook with particularly thin cables to be protected is reduced by using U-shaped hooks.

The first and second shells may be connected via a hinge. A hinge is advantageous, since only one physical part, and not two separate shells, has to be handled in the supply process. Still further, a hinge limits the degree of freedoms of the connected parts and therefore facilitates the assembly of the conduit adapter system, since the second shell is guided by the hinge. The hinge can be a flexible web, a joint or any suitable connection between the first and second shell that allows the second shell to be moved from a position in the pre-assembled condition to its final position; i.e. when the second shell is fixed to the first shell.

The hinge that connects the first shell and the second shell bay be arranged between a first front end of the first shell and a second front end of the second shell. The first front end is orientated opposite to the electrical connector assembly in the pre-assembled condition, and the second front end points in the same direction as the first front end, when the first and second shell are fixed together. Thus, the first and second front ends build together an opening, when the first and second shells are fixed together, which opening encloses a cable of the electrical connector assembly. When the first and second shells are fixed together, the opening is in a plane perpendicular to the direction of the enclosed cable.

When the first and second shells are fixed together, the hinge may extend in the direction of the cables of the electrical connector assembly. As used herein, the term "the direction of the cables" means the direction relating to the cable that is enclosed by the opening defined by the first front end and the second front end. In contrary to the prior art, the hinge is therefore not located at a side of a first shell and/or second shell. Thus, no extra space is required for the hinge in the radial direction of the cables. This allows the connectors and corresponding conduit adapters to be placed in close proximity to each other. Still further, since the hinge is not provided at the longitudinal axis at the side of the shells, this space is available for fixing elements. Thus identical formed fixing elements can be provided at the shells.

An electrical cable of the electrical connector assembly may be guided by the conduit adapter. The hinge that connects the first shell and the second shell provides an axis of rotation that is essentially perpendicular to the longitudinal direction of the cables of the electrical connector assembly. With the longitudinal direction of the cables is at meant the longitudinal direction of the cable that is enclosed by the opening defined by the first front end and the second front end.

A hinge that provides an axis of rotation that is essentially perpendicular to the longitudinal direction of the cables of the electrical connector assembly and connects the first shell and the second shell of the conduit adapter is advantageous, since the second shell can be moved to the first shell with reduced space requirements on the sides of the conduit adapter, compared to conduit adapters, where the hinge is provided at the side of the shells. The hinge may provide at least a second axis of rotation that allows moving the second shell in an evasive movement around the cables of the electrical connector assembly. The reduced laterally space requirement allows multiple connectors to be placed in close proximity to each other.

The hinge may be a flexible web that is integrally formed with the first and second shell. Using a flexible web as the hinge is advantageous, since the first and second shell as well as the flexible web can be produced in a single step, for example by means of injection molding. Alternatively, the flexible web can be soldered, welded, adhered or fixed in any other suitable way to the first and second shell.

Such a flexible web allows a rotation of the second shell around an axis perpendicular to the direction of the cables of the electric conduit adapter as described above. Further, such a flexible web also allows torsional movement of the second shell, so that the space requirements during the assembly of the conduit adapter can be reduced, as described above.

The conduit adapter may provide a strain relief and the first and/or the second shell may provide openings that are suitable to guide a cable strap that fixes the cable of the electrical connector assembly to the first and/or second shell of the conduit adapter.

A strain relief functionality of the conduit adapter can for example be achieved by protrusions that are provided at the shells of the conduit adapter and which protrusions are orientated inwardly, when the first shell and the second shell are fixed together so that the cables of the electrical connector assembly are clamped by the protrusions.

Alternatively, a cable strap can be used that is guided through openings provided in the first and/or second shell. Providing strain relief functionality is advantageous, since cable or connector damages due to traction and/or bending forces can be reduced.

Particularly the combination of the features of the pre-locking of the first shell to the electrical connector assembly and the openings in one of the first and/or second shell is advantageous, since the cables can be fixed by means of the cable strap to the conduit adapter in the pre-assembled condition. A manufacturer would have to handle only two parts that are easily accessible.

The conduit adapter system may include an electrical connector assembly wherein the electrical connector assembly provides a pre-locking means. The pre-locking means of the electrical connector assembly corresponds to the pre-locking means of the conduit adapter.

Still further, a method to assemble the conduit adapter system including an electrical connector assembly and a conduit adapter is presented. The method includes the following steps:

a) Locking the first shell to the electrical connector assembly by engaging the pre-locking means of the first shell with corresponding pre-locking means of the electrical connector assembly;
b) Fixing the second shell to first shell that is locked to the electrical connector assembly by using first and second fixing elements.

Locking the first shell to the electrical connector assembly is advantageous, since after pre-locking the first shell to the connector assembly, an operator can use both hands to e.g. guide the cables of the electrical connector assembly or to fix the cables by means of a cable strap to the first shell. Further, also in step b), when the second shell is fixed to the first shell only two parts have to be handled simultaneously. Thus the assembly of the conduit adapter system can be facilitated.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
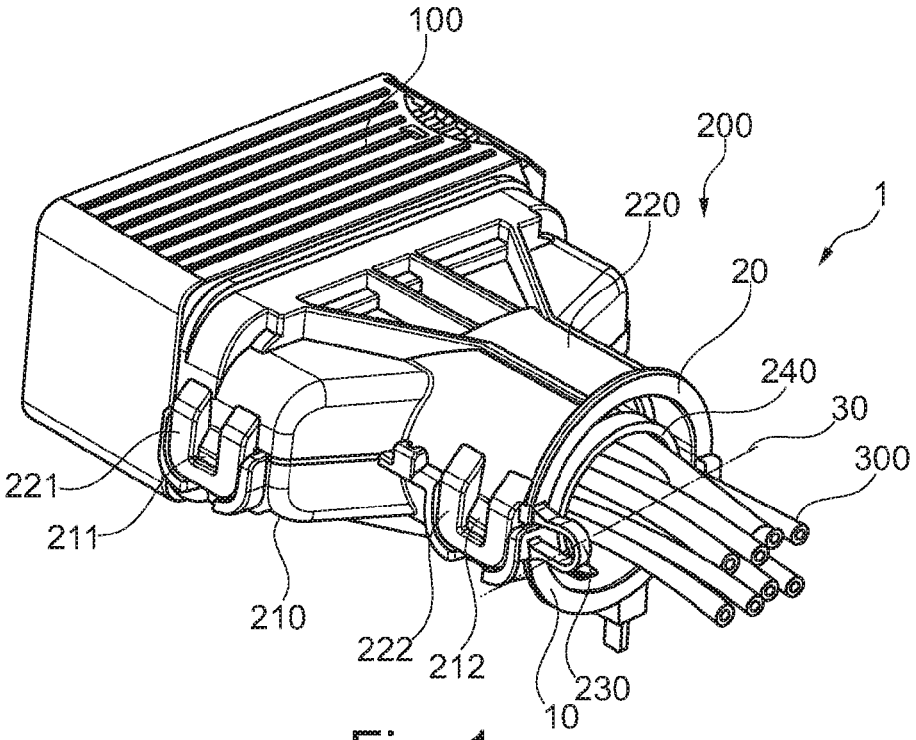
FIG. 1 shows a conduit adapter system in an assembled condition, wherein the conduit adapter is mounted to an electrical connector assembly according to one embodiment.

FIG. 1 shows a non-limiting example of the conduit adapter system 1 in an assembled condition, wherein the conduit adapter 200 is mounted to an electrical connector assembly 100. In the assembled condition, the conduit adapter 200 is mounted to the electrical connector assembly 100 and the first shell 210 of the conduit adapter 200 is fixed to the second shell 220 by fixing elements. The fixing elements 211, 212 of the first shell 210 are formed as latching elements, and in particular as latching noses. The fixing elements 221 and 222 of the second shell 220 are formed as corresponding fixing elements, namely latching elements and in particular as latching hooks formed in a U-shape.

The first front end 10 of the first shell 210 is oriented opposite to the electrical connector assembly 100. The second front end 20 of the second shell 220 points in the same direction as the first front and 10 in the assembled condition as shown. Thus, both the first and the second front ends (10, 20) form an opening that guides the cables 300 of the electrical connector assembly 100. The first shell 210 and the second shell 220 are connected via a hinge 230 that is formed as a flexible web and arranged between the first front end 10 and the second front end 20. This hinge 230 provides an axis of rotation 30 that is perpendicular to the longitudinal direction of the cables 300 of the electrical connector assembly 100. In the assembled condition shown, the hinge 230 extends in the direction of the cables 300. Further, the cables 300 are fixed to the first shell 210 by means of a cable strap 240.

Figure 2:
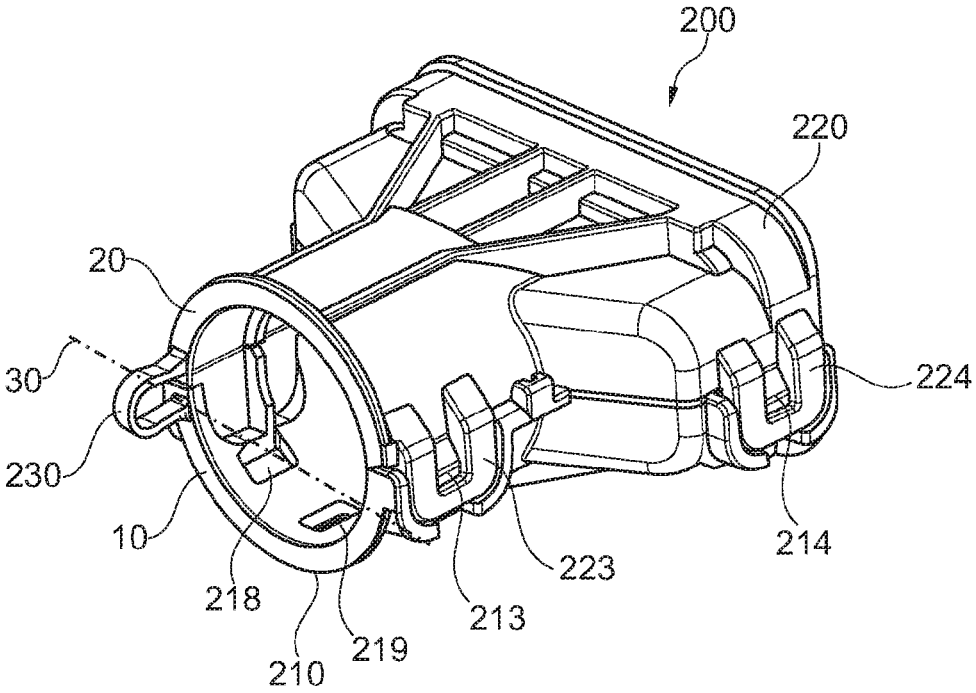
FIG. 2 shows the conduit adapter of FIG. 1 according to one embodiment.

FIG. 2 shows the conduit adapter 200 of FIG. 1 from a different perspective so that the other side of the conduit adapter is shown. In the embodiment shown in FIG. 2, the second shell 220 is fixed to the first shell 210 by fixing elements. The fixing elements 213, 214 of the first shell 210 are formed as latching elements, and in particular as latching noses. The fixing elements 223 and 224 of the second shell 220 are formed as corresponding fixing elements, namely latching elements and in particular as latching hooks formed in a U-shape. The embodiment of the conduit adapter 200 shown in FIG. 1 and FIG.2 provides four identical fixing elements that are formed as latching noses and corresponding U-shaped latching hooks.

Further, as can be seen in FIG. 2 the first shell 210 provides two openings 218, 219 that are suitable to guide a cable strap 240 in order to fix cables to the first shell 210. The fixation of the cables 300 to the first shell 210 by means of a cable strap 240 can for example be seen in FIG. 1.

Figure 3:
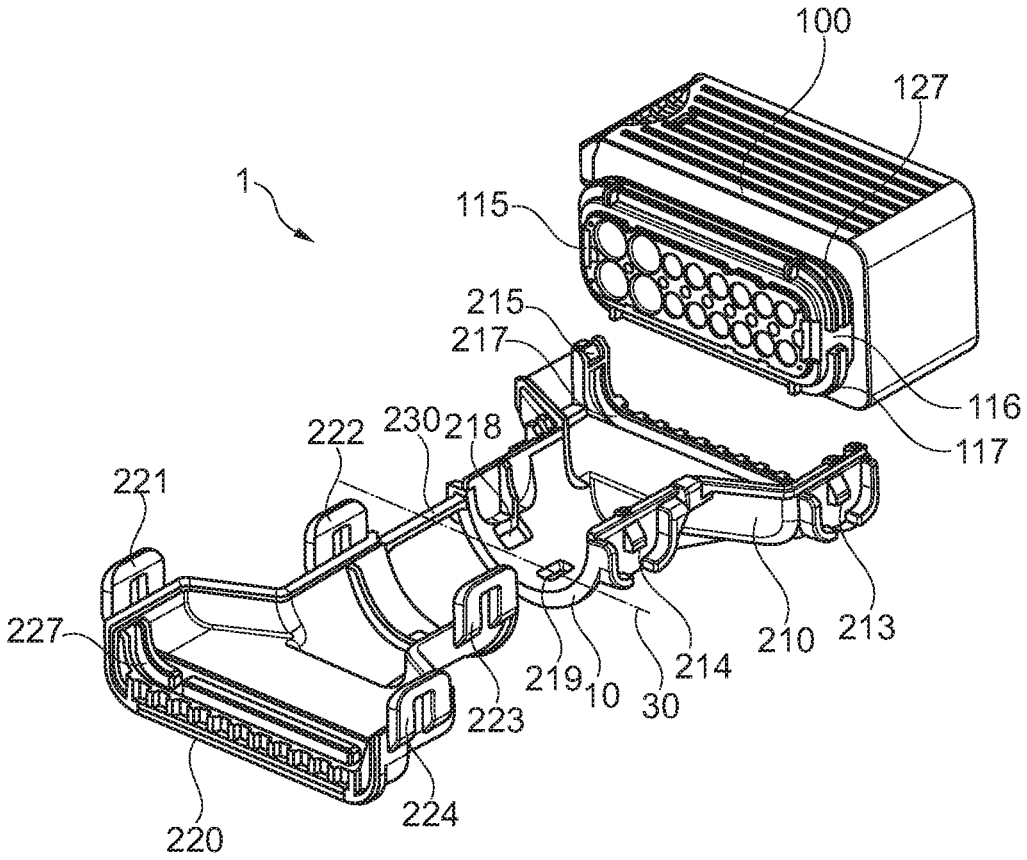
FIG. 3 shows the conduit adapter system of FIG. 1 in an initial condition according to one embodiment, wherein the electrical connector assembly is shown without cables.
Figure 4:
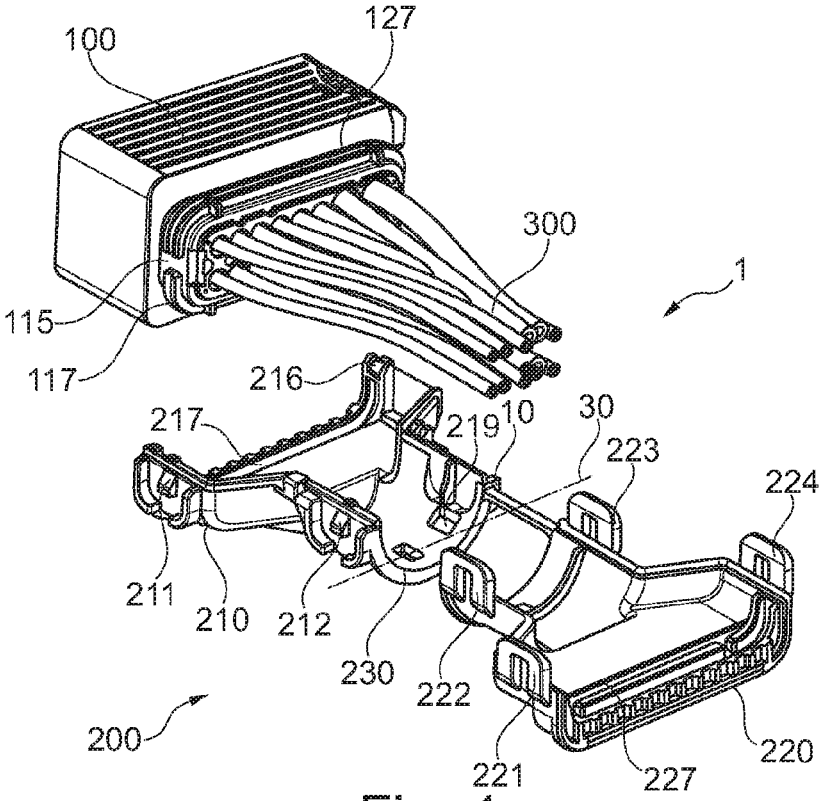
FIG. 4 shows the conduit adapter system of FIG. 3 in an initial condition according to one embodiment, from a different perspective.

FIGS. 3 and 4 show the conduit adapter system 1 of FIG. 1 in an initial condition, wherein the electrical connector assembly 100 is shown without cables in FIG. 3. In the initial condition, the conduit adapter 200 is completely separated from the electrical connector assembly 100 and the first shell 210 and the second shell 220 are not fixed together.

The electrical connector assembly 100 provides a first collar 117 that is engageable with a first groove 217 of the first shell 210 of the conduit adapter 200. The electrical connector assembly 100 provides a second collar 127 that is engageable with the second groove of the second shell 220 of the conduit adapter 200. In the assembled condition (cf. FIG. 1), the engagement of grooves and collars provides a high mechanical stability of the connection between the electrical connector assembly 100 and the conduit adapter 200 in particular in the axial direction. The axial direction is the longitudinal direction of the cables.

The first shell 210 includes a pre-locking means 215 that is formed as latching protrusion, which is arranged in the first groove 217. The pre-locking means 215 can be engaged with the corresponding pre-locking means 115 of the electrical connector assembly 100. The corresponding pre-locking means 115 is a latching recess that is formed in the first collar 117 of the electrical connector assembly 100. The electrical connector assembly 100 provides a further (second) corresponding pre-locking means 116 that is a latching recess. The corresponding pre-locking means 116 can be engaged with a second pre-locking means 216 of the first shell (cf. FIG. 4). By engaging the pre-locking means 215, 216 with the corresponding pre-locking means 115, 116, the first shell 210 of the conduit adapter 200 can be locked to the electrical connector assembly 100, to achieve the pre-assembled condition shown in FIG. 6.

Still further, the first shell 210 provides fixing elements 213, 214 that are formed as latching noses. The second shell 220 provides corresponding fixing elements 211, 212, 213, 214 that are formed as latching hooks. The first shell further provides two openings 218, 219 that are suitable to guide a cable strap in order to fix cables to the first shell 210.

As can be seen, the hinge 230 that connects the first shell 210 with the second shell 220 is a flexible web and is integrally formed with the first 210 and second shell 220. The hinge 230 is connected to the first shell 210 at the first front end 10 and provides an axis of rotation 30, that is perpendicular of the direction of the cables 300 (cf. FIG. 4) of the electrical connector assembly 100.

Figure 5:
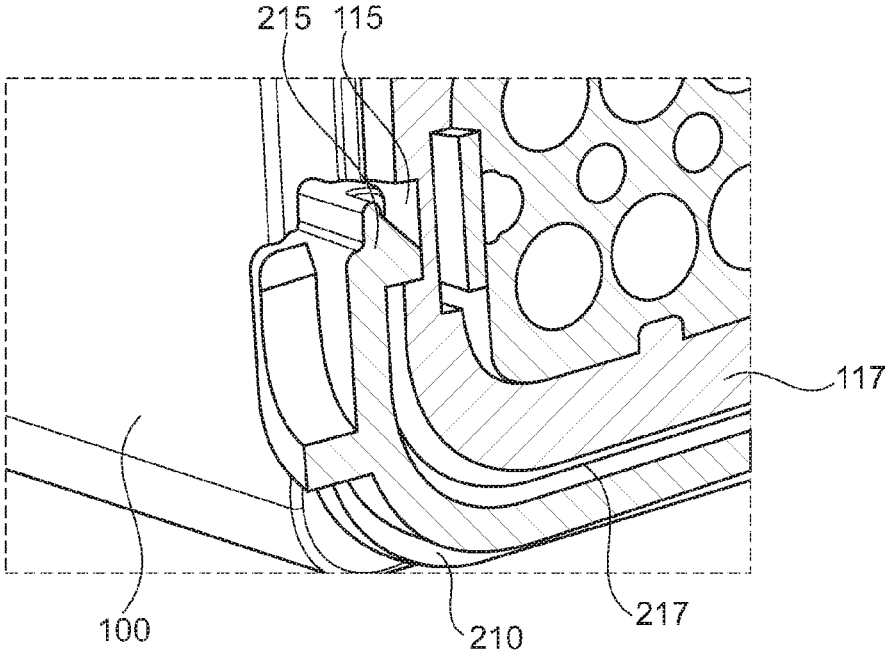
FIG. 5 shows a cut view of the pre-locking means of the first shell of the conduit adapter of FIG. 1 being locked to the corresponding pre-locking means of the electrical connector assembly according to one embodiment.

FIG. 5 shows a cut view of the pre-locking means 215 of the first shell 210 of the conduit adapter 200 of FIG. 1 being locked to the corresponding pre-locking means 115 of the electrical connector assembly 100 in the pre-assembled condition. In the pre-assembled condition, the pre-locking means 115, 116 of the first shell 210 are engaged with the corresponding pre-locking means 115, 116 of the electrical connector assembly. In one embodiment, the pre-locking means 215, 216 is a latching nose that engages with the corresponding latching recess 115, 116 of the electrical connector assembly 100. As can further be seen, the first collar 117 engages with the first groove 217 of the first shell 210, to provide a high mechanical stability.

Figure 6:
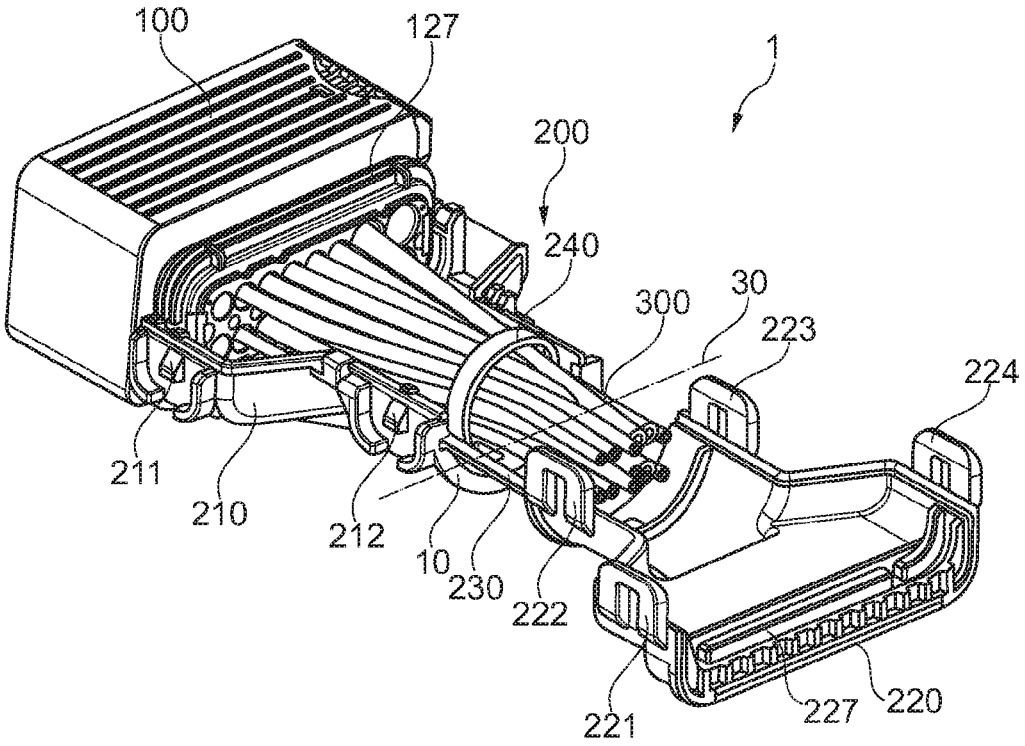
FIG. 6 shows the conduit adapter system of FIG. 1 in a pre-assembled condition according to one embodiment.

FIG. 6 shows the conduit adapter system of FIG. 1 in the pre-assembled condition. In the pre-assembled condition, the first front end 10 of the first shell 210 is oriented opposite to the electrical connector assembly 100. Further, in the pre-assembled condition, the cables 300 are guided by the first shell 210. Thus, the cables 300 can be fixed to the first shell 210 of the conduit adapter 200 by means of a cable strap 240, as shown.

In order to fix the second shell 220 together with the first shell 210, the second shell 220 has to be moved around the cables 300 around an axis or rotation 30 perpendicular to the direction of the cables. The hinge 230 is sufficiently flexible to allow such a movement. To facilitate the fixing of the second shell 220 to first shell 210, the correct position of this second shell 220 the second collar 127 engages the corresponding second groove, so that the second shell 220 is guided in the correct axial position, even before the fixing elements are fixed to each other. The fixing elements 221, 222, 223, 224 that are formed as U-shaped hooks, guide the second shell in the sideward direction even before the fixing elements are fixed to each other.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A conduit adapter system that is configured to be connected to an electrical connector assembly, the conduit adapter system comprising:

a conduit adapter, wherein the conduit adapter comprises a first shell and a second shell, wherein the first shell comprises a first fixing element and the second shell comprises a corresponding second fixing element so that the first and second shell can be fixed together, and wherein the first shell comprises a pre-locking means that can be engaged with a corresponding pre-locking means of the electrical connector assembly, to lock the first shell to the electrical connector assembly in a pre-assembled condition.

2. The conduit adapter system according to claim 1, wherein the pre-locking means of the first shell and the corresponding pre-locking means of the electrical connector assembly are formed as latching protrusions and corresponding latching recesses.

3. The conduit adapter system according to claim 1, wherein the first shell defines a first groove that can be engaged with a first collar of the electrical connector assembly in the pre-assembled condition.

4. The conduit adapter system according to claim 3, wherein the pre-locking means of the first shell is formed as a latching protrusion that may be arranged in the first groove, and the corresponding pre-locking means of the electrical connector assembly is formed as a latching recess that is formed in the first collar of the electrical connector assembly.

5. The conduit adapter system according to claim 3, wherein the second shell comprises a second groove that can be engaged with a second collar of the electrical connector assembly, and wherein the second collar is integrally formed with the first collar of the electrical connector assembly.

6. The conduit adapter system according to claim 1, wherein the first shell comprises at least two first fixing elements that are formed identically, wherein the second shell comprises corresponding second fixing elements.

7. The conduit adapter system according to claim 1, wherein the first fixing element and the corresponding second fixing element are formed as latching recesses and corresponding latching protrusions.

8. The conduit adapter system according to claim 7, wherein the latching hooks are U-shaped.

9. The conduit adapter system according to claim 1, wherein the first and second shell are connected via a hinge.

10. The conduit adapter system according to claim 9, wherein the hinge that connects the first shell and the second shell is arranged between a first front end of the first shell and a second front end of the second shell, and wherein the first front end is orientated opposite to the electrical connector assembly in the pre-assembled condition, and the second front end points in the same direction as the first front end, when the first and second shell are fixed together.

11. The conduit adapter system according to claim 9, wherein an electrical cable of the electrical connector assembly is guided by the conduit adapter, and wherein the hinge that connects the first shell and the second shell provides an axis of rotation that is essentially perpendicular to the electrical cable of the electrical connector assembly.

12. The conduit adapter system according to claim 11, wherein the hinge extends in a direction of the electrical cable of the electrical connector assembly.

13. The conduit adapter system according to claim 11, wherein the hinge provides at least a second axis of rotation for allowing moving the second shell in an evasive movement around the electrical cable of the electrical connector assembly.

14. The conduit adapter system according to claim 9, wherein the hinge is a flexible web that is integrally formed with the first and second shell.

15. The conduit adapter system according to claim 11, wherein the conduit adapter is a strain relief and wherein the first or the second shell provide openings that are suitable to guide a cable strap that fixes the electrical cable of the electrical connector assembly to the first or second shell of the conduit adapter.

16. The conduit adapter system according to claim 1, further comprising an electrical connector assembly, wherein the electrical connector assembly provides the pre-locking means.

17. A method to assemble a conduit adapter system including an electrical connector assembly and a conduit adapter, wherein the conduit adapter comprises a first shell and a second shell, wherein the first shell comprises a first fixing element and the second shell comprises a corresponding second fixing element so that the first and second shell can be fixed together, and wherein the first shell comprises a pre-locking means that can be engaged with a corresponding pre-locking means of the electrical connector assembly, to lock the first shell to the electrical connector assembly in a pre-assembled condition, the method comprising the steps of:

a. locking the first shell to the electrical connector assembly by engaging the pre-locking means of the first shell with the corresponding pre-locking means of the electrical connector assembly;

b. fixing the second shell to the first shell that is locked to the electrical connector assembly by using first and second fixing elements.

* * * * *